US005127852A

United States Patent [19]

Cravens et al.

[11] Patent Number: 5,127,852

[45] Date of Patent: Jul. 7, 1992

[54] MOUNTING DEVICE FOR ELECTRICAL CONNECTORS

[75] Inventors: David M. Cravens, Etters; Earl J. Hayes, Mechanicsburg, both of Pa.

[73] Assignee: AMP Incorporated, Harrisburg, Pa.

[21] Appl. No.: 602,603

[22] Filed: Oct. 24, 1990

[51] Int. Cl.[5] ..... H01R 13/74

[52] U.S. Cl. ..... 439/545; 439/557

[58] Field of Search ..... 439/545, 547–549, 439/546, 557, 565, 567; 248/27.3

[56] References Cited

U.S. PATENT DOCUMENTS

| | | | |
|---|---|---|---|
| 3,535,675 | 10/1970 | Baumanis | 439/567 |
| 4,029,953 | 6/1977 | Natoli | 439/546 |
| 4,033,663 | 7/1977 | McCardell | 439/545 |
| 4,352,538 | 10/1982 | Fowler | 439/545 |
| 4,406,510 | 9/1983 | Debortoli et al. | 439/567 |
| 4,761,144 | 8/1988 | Hunt III et al. | 439/545 |
| 4,845,589 | 7/1989 | Weidler et al. | 439/374 |

*Primary Examiner*—Gary F. Paumen

*Attorney, Agent, or Firm*—Allan B. Osborne; Bruce J. Wolstoncroft

[57] ABSTRACT

A mounting device (40) for mounting electrical connectors (10) in a cut-out (32) in a panel (30) without using separate fastening members is disclosed. The mounting device (40) includes a rigid plate (70) attached to each of two opposite sides (22) of the connector (10) and a resilient wing attached to each side (22) in spaced relation to the plate (70) for receiving the panel (30) therein. Bosses (54) on the wings (42) enter windows (34) in the panel (30) to secure the electrical connector (10) in the panel (30).

2 Claims, 4 Drawing Sheets

MOUNTING DEVICE FOR ELECTRICAL CONNECTORS

FIELD OF THE INVENTION

The disclosed invention relates to electrical connectors for use in motor vehicles and more particularly to the mounting of the connector within the vehicle.

BACKGROUND OF THE INVENTION

Prior art and contemporary electrical connectors used in motor vehicles are secured therein by fasteners such as bolts and screws. The use of such fasteners was necessitated by the amount of vibrations the connectors are subjected to which, unless the connectors were securely fastened, could cause a malfunction. The drawback, however, to the use of such fastening devices is that the areas within the vehicle receiving the connectors are small and often times hidden from view. Accordingly, it is now proposed to provide a connector which can be mounted without the use of bolts, screws and other like devices.

SUMMARY OF THE INVENTION

According to the invention, a mounting device for an electrical connector is provided which includes a rigid plate on each of two opposing sides of the connector, a resilient wing spaced from each plate by a distance equal to the thickness of a panel in which the connector is to be mounted and bosses on the wings which are received in windows in the panel. The bosses include a slanted surface which engages an edge of the windows to maintain a constant force between the panel and connector.

DESCRIPTION OF THE INVENTION

Figure 1:
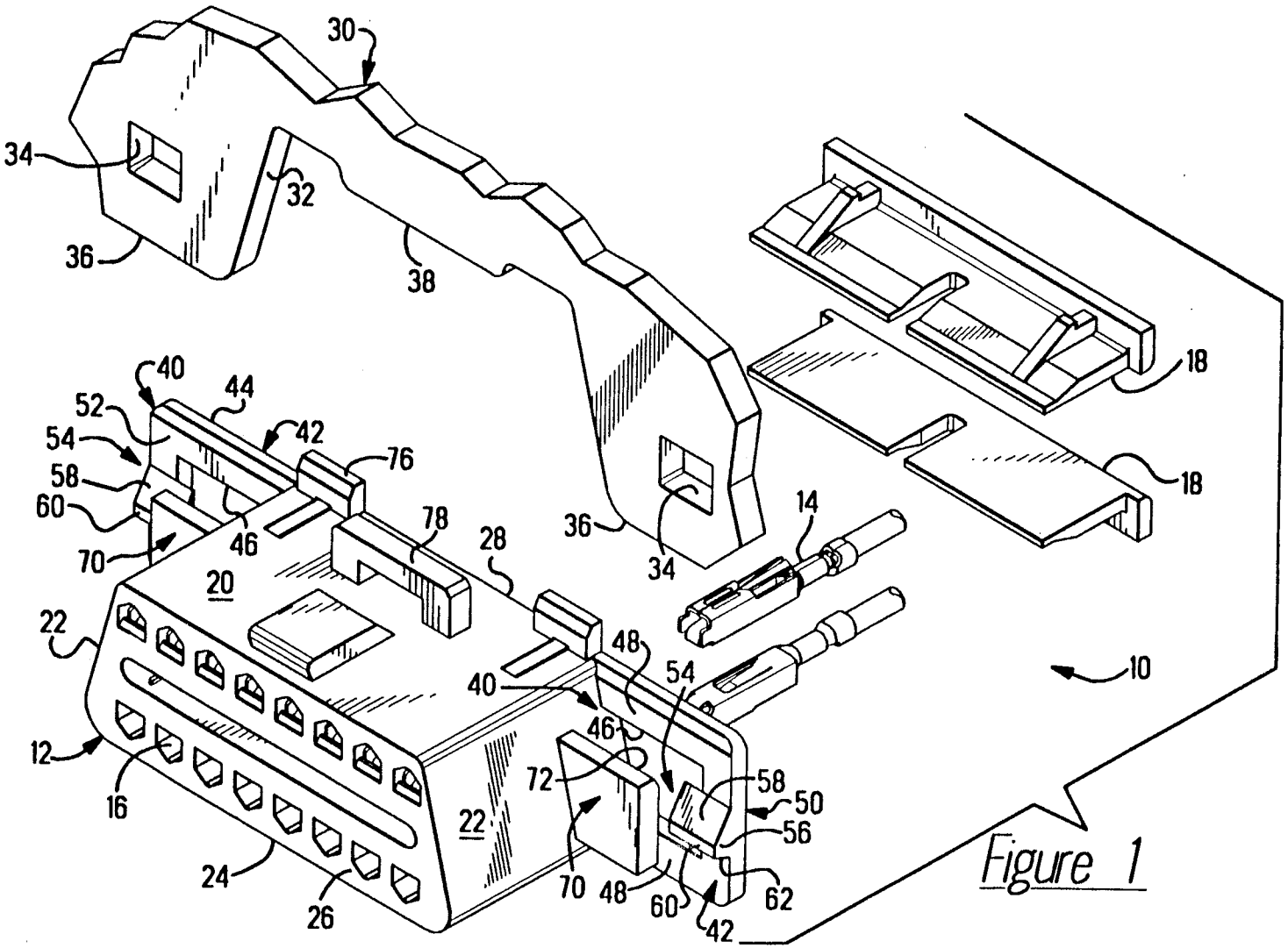
FIGS. 1 and 2 are perspective, frontal and rear views respectively of a connector employing the mounting device of the present invention, the terminals of the connector and the connector mounting panel.
Figure 2:
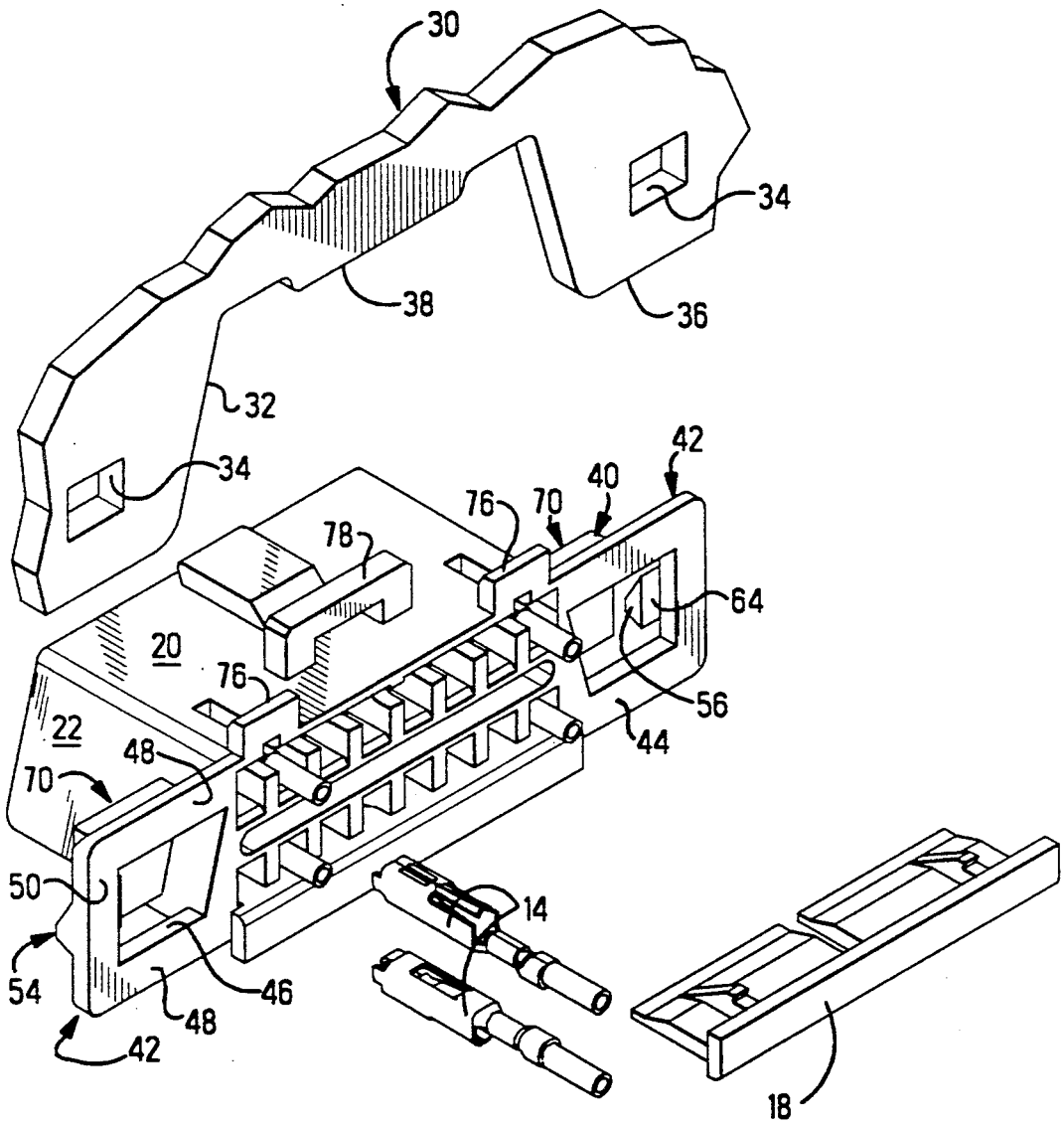

With reference to FIGS. 1 and 2, connector 10 includes a housing 12, terminals 14 which are positioned in cavities 16 of housing 12 and terminal retaining members 18 which retain terminals 14 in cavities 16. Other types of connectors than that shown may also employ the mounting device to be described below.

Housing 12 is a molding having a top 20, side 22, bottom 24, front face 26 and rear face 28. The preferred material used in molding housing 12, particularly with respect to the mounting device 40 of the present invention is nylon.

Mounting device 40 is designed to be used with panel 30 wherein the connector 10 is slid into cut-out 32 and in cooperation with panel windows 34. Panel 30 also includes lower edges 36 located below windows 34 and upper cut-out edge 38.

Mounting device 40 includes resilient wings 42 which project laterally outwardly from housing sides 22. The rearwardly facing surfaces 44 of wings 42 are on the same plane as rear face 28 but this is not particularly necessary relative to the present invention. Opening 46 through wings 42 define a pair of cantilever beams 48 and a strap 50 which is normal to and joins beams 48 remote from sides 22.

Figure 4:
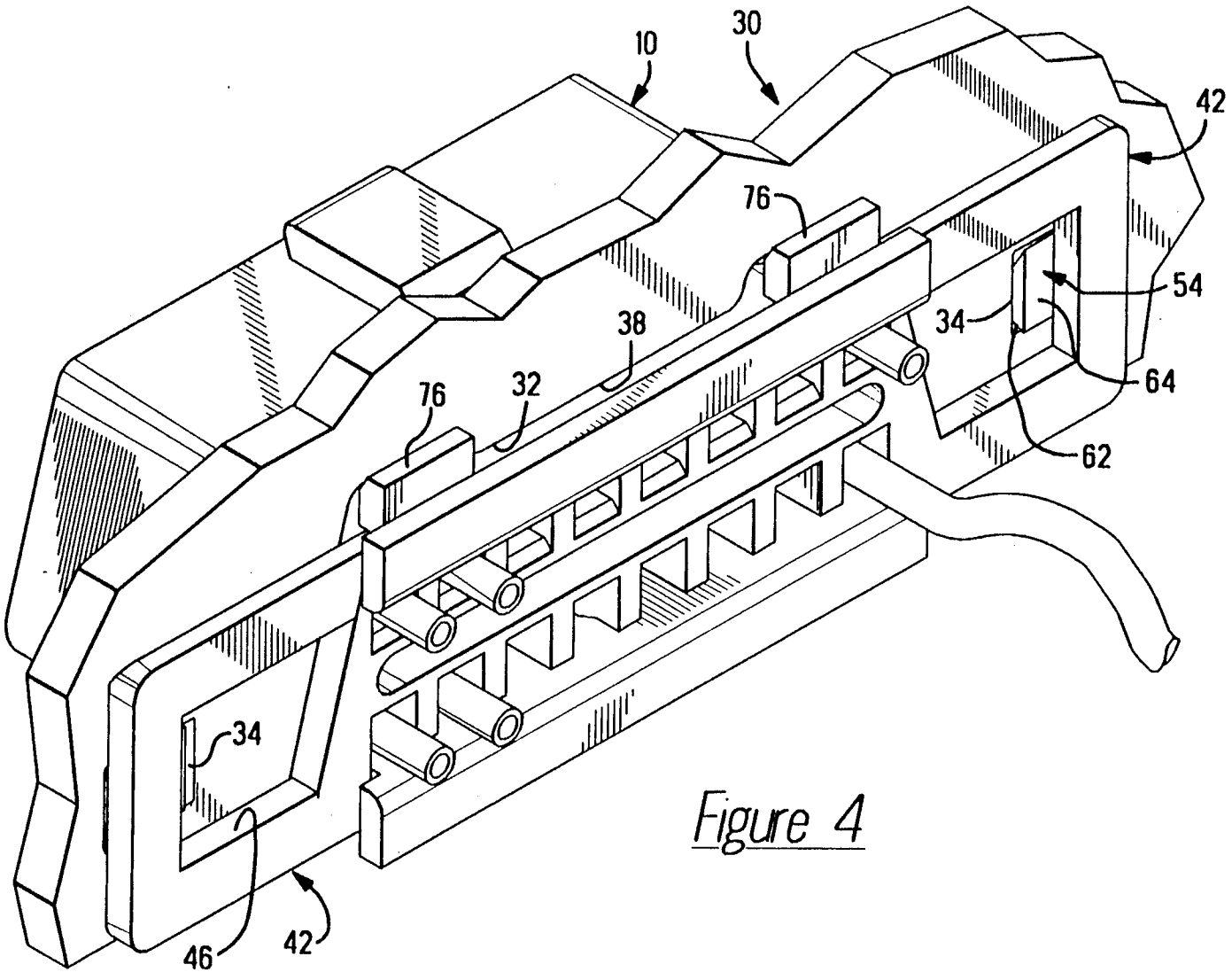

Each strap 50 carries on the wing's forwardly facing surfaces 52, a boss 54. As shown, boss 54 is defined by sides 56, a slanted first surface 58, a flat, forwardly facing surface 60, a slanted second surface 62 and, in the embodiment illustrated, a rear surface 64 (FIGS. 2,4).

The angle of first surface 58 relative to the plane of the wing's forwardly facing surface 52 is about 30 degrees. The angle of second surface 62 relative to surface 52 is about 113 degrees. The significance of these angled surfaces 58,62 is noted below.

While wings 42 are resilient, the amount of resiliency is not great as will be discussed below. Further, preferably wings 42 are molded with a slight forward inclination but this is not critical.

Plates 70 comprise another component of mounting device 40. Plates 70 project laterally outwardly from sides 22 of housing 12. The rearwardly facing surface 72 of plates 70 are precisely spaced from the forwardly facing surface 52 of wings 42 by the thickness of panel 30. Plates 70 provide a back-up and thus are quite thick and accordingly are very rigid. The distance plates 70 extend outwardly from sides 22 are not too critical but preferably they should extend out to be in line with straps 50 on wings 42.

Bracketing members 76,78 are located on housing top 20 with members 76 being on the rear edge and center bracketing member 78 being in between members 76 and located forwardly therefrom to define a space equal to the thickness of panel 30. Members 76,78 comprise the final components of mounting device 40.

Connector 10 is mounted onto panel 30 by being pushed into cut-out 32. As the lower panel edges 36 enter the space between wings 42 and non-movable plates 70, they engage and slide along the slanted first surfaces 58 on bosses 54. As the space decreases, wings 42 resiliently move or swing back until windows 34 come in line with bosses 54. At that point bosses 54 enter the windows 34 under the energy of wings 42 as they move forwardly toward their non-stressed location. As best seen in FIG. 4, the second surfaces 62 on bosses 54 engage an edge of windows 34. This positioning, which is critical, results in a continual pressure being exerted between mounting device 40 and panel 30 with the result that connector 10 will not move or even vibrate during the anticipated several years of service.

Figure 3:
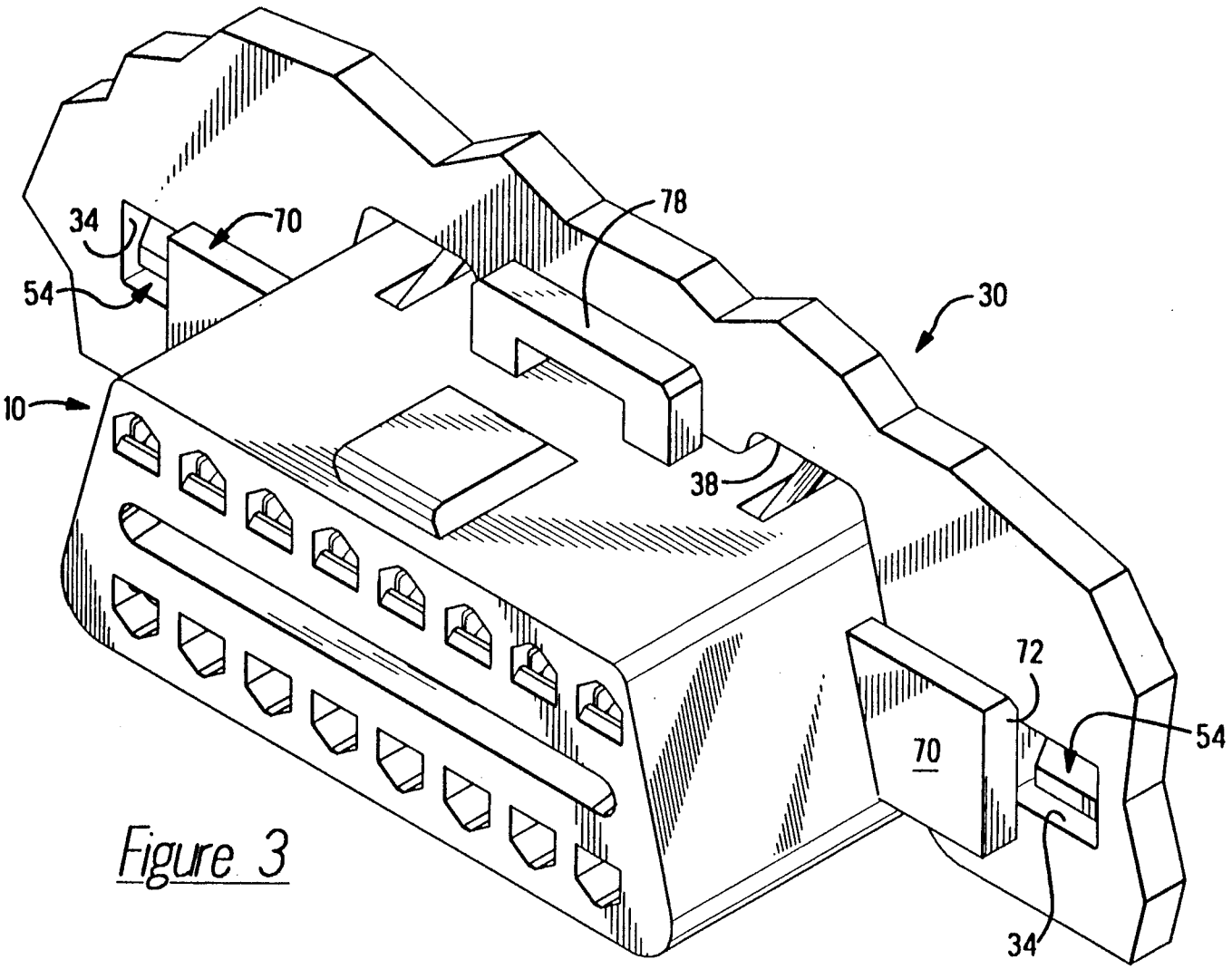
FIGS. 3 and 4 are perspective frontal and rear views respectively of the connector mounted in the panel.

As bosses 54 are entering windows 34, upper cut-out edge 38 is entering in between bracketing members 76,78 as shown in FIGS. 3 and 4. The receipt of edge 38 therein prevents connector 10 from tilting.

As can be discerned from the foregoing description, a mounting device for electrical connectors which do not require separate hardware has been disclosed. The mounting device includes bosses mounted on semi-resilient wings and a rigid back-up member or plate spaced therefrom for receiving a panel therebetween. The bosses include a shallow slanted surface which engages an edge of the windows in the panel in which the bosses are received. This positioning creates a continual force between the panel and mounting device so that the accompanying connector cannot move or vibrate.

I claim:

1. A mounting device (40) for use on electrical connectors (10) being mounted in a cut-out (32) in a panel (30) having windows (34) adjacent each of two facing sides of the cut-out (32), said mounting device (40) comprising:

a rigid plate (70) attached to and projecting laterally outwardly from each of two opposing sides (22) of an electrical connector (10), and a resilient wing (42) attached to and projecting laterally outwardly from each of said two opposing sides (22) with a space between said wings (42) and said plates (70) being a distance equal to the thickness of a penal (30) in which the electrical connector (10) is to be mounted, further, each of said wings (42) having positioned thereon a boss (54) facing a respective said plate (70) and extending into said space, each of said bosses (54) adapted to enter a window (34) in the panel and having a slanted surface (62) which engages and is supported by an edge of the window (34).

2. The device (40) of claim 1 wherein said slanted surface (62) on said boss (54) is at an angle of about 113 degrees relative to the plane of said wing (42).

* * * * *